United States Patent [19]

Harrigan

[11] Patent Number: 4,711,371

[45] Date of Patent: Dec. 8, 1987

[54] CARD DISPENSER GUARD APPARATUS

[76] Inventor: Donald R. Harrigan, R.D. 4, Box 243, English Creek Rd., McKee City, N.J. 08232

[21] Appl. No.: 884,016

[22] Filed: Jul. 10, 1986

[51] Int. Cl.[4] ..... A47F 1/12; A63F 1/10

[52] U.S. Cl. ..... 221/310; 211/51; 273/148 A

[58] Field of Search ..... 221/267, 306, 307, 308, 221/309, 310; 273/148 A, 149 R; 211/51; 312/50, 61

[56] References Cited

U.S. PATENT DOCUMENTS 701,358 6/1902 Klepetar ..... 221/267

2,288,870 7/1942 Weber et al. ..... 221/267 X

FOREIGN PATENT DOCUMENTS 572837 6/1924 France ..... 273/148 A

*Primary Examiner*—F. J. Bartuska

[57] ABSTRACT

A card-dispenser guard apparatus for a playing-card dealing shoe, the apparatus comprising a plate having an opening therethrough, the opening having disposed therein a flexible closure partable along a vertical axis thereof. In a preferred embodiment, the flexible closure comprises a plurality of closely adjacent tensioned strands which extend from the perimeter of the opening and whose ends meet along a vertical axis of the opening essentially mid-way between the lateral sides of the opening to thereby provide right strands extending from the right perimeter and left strands extending from the left perimeter of the opening. The right and left strands extend at opposing downward angles as measured from a horizontal plane so that the angles and the ends of the right and left strands converge along the vertical axis. The apparatus conceals from view a playing card next to be dealt, and, in the above-described preferred embodiment, a dealer of the playing cards is inhibited from dealing a card other than that which is meant to be dealt next.

7 Claims, 7 Drawing Figures

CARD DISPENSER GUARD APPARATUS

BACKGROUND OF THE INVENTION

This invention relates generally to a playing card dispenser commonly termed a "shoe," and in particular to a dispenser guard apparatus for said shoe which conceals from view the surface of the card next to be dealt, and preferably also inhibits reverse movement of the card next to be dealt in favor of dealing a card there behind.

Both the gaming industry and individuals employ playing card dispensers, commonly termed "shoes," for dealing cards to players. In the card game of blackjack, for example, a shoe is stocked with one or more decks of shuffled playing cards. After players make their wagers, a dealer then deals cards to the players by withdrawing one card at a time from the shoe. Commonly, the front panel of a shoe has an enlarged opening through a portion thereof, and the stock of playing cards is maintained against the panel. The panel is disposed to provide a slot between its bottom edge and the floor of the shoe. A dealer withdraws one card at a time by placing a finger through the enlarged opening and sliding the card downwardly through the slot.

Because of the opening in the front panel, players can see the back side of the card next to be dealt. Therefore, if a player had previously marked a card, he would be able to see this mark before he wagered and before the card was dealt. Likewise, if a dealer had previously marked a card for a player or knew of such marking, the dealer would see the marked card before it was dealt. By slight of hand, if he were saving the marked first card for someone other than the rightful recipient of that card, the dealer could raise that card upwardly with one finger through the enlarged opening, and proceed to deal the card immediately behind the marked card.

Such cheating is a dangerous and potentially economically harmful threat to the gaming industry. Present attempts to hide a card from view include the dealer's placing of his hand over the enlarged opening; placing a drape-tape cover over the front of the shoe until players have placed their bets; or employing a shoe which has a sliding door manually operable in a channel to close or open the enlarged opening. None of these approaches alleviates the problem of a dishonest dealer since he has full access to the cards. Further, the drape-type cover and the sliding door slow the speed of each game significantly.

It is therefore apparent that a need is present for means which will reduce the potential for dealer and/or player cheating through the marking of cards. Accordingly, it is a primary object of the instant invention to provide a card-dispenser guard apparatus which conceals from view the playing card next to be dealt from a card-dispensing shoe.

It is a further object of the invention to provde such a guard apparatus which can also inhibit a dealer's ability and opportunity to retain a card which is rightfully next to be dealt.

Yet another object of the invention is to provide such a guard apparatus which does not act to slow the speed of the game in which it is employed.

These and other objects will become apparent throughout the following description of the invention.

SUMMARY OF THE INVENTION

The subject of the instant invention is a card-dispenser guard apparatus for a playing-card dealing shoe, said apparatus comprising a plate having a front side, a back side, and an opening therethrough, with said opening having flexible closure means partable along an essentially vertical axis thereof. The opening through the plate is registerable with an opening in the front of the shoe through which finger access to playing cards stocked in the shoe is accomplished. The back side of the plate can be provided with securement means for securing the plate to the front of the shoe.

In a preferred embodiment, the flexible closure means comprises a plurality of closely adjacent tensioned strands or bristles which extend from the perimeter of the opening and meet along a vertical axis of the opening essentially mid-way between the lateral sides of said opening to thereby provide strands extending from the right perimeter of the opening and from the left perimeter of the opening. The tensioned strands are disposed to extend at opposing downward angles as measured from a horizontal plane, with said angles and the ends of the strands converging along said vertical axis.

Also a subject of the instant invention is a playing-card dealing shoe comprising a front panel comprising a plate having an opening therethrough, with said opening having flexible closure means partable along an essentially vertical axis thereof. In a preferred embodiment of the shoe, the flexible closure means are as described above for the preferred embodiment of the guard apparatus.

DETAILED DESCRIPTION OF PREFERRED EMBODIMENTS

Figure 1:
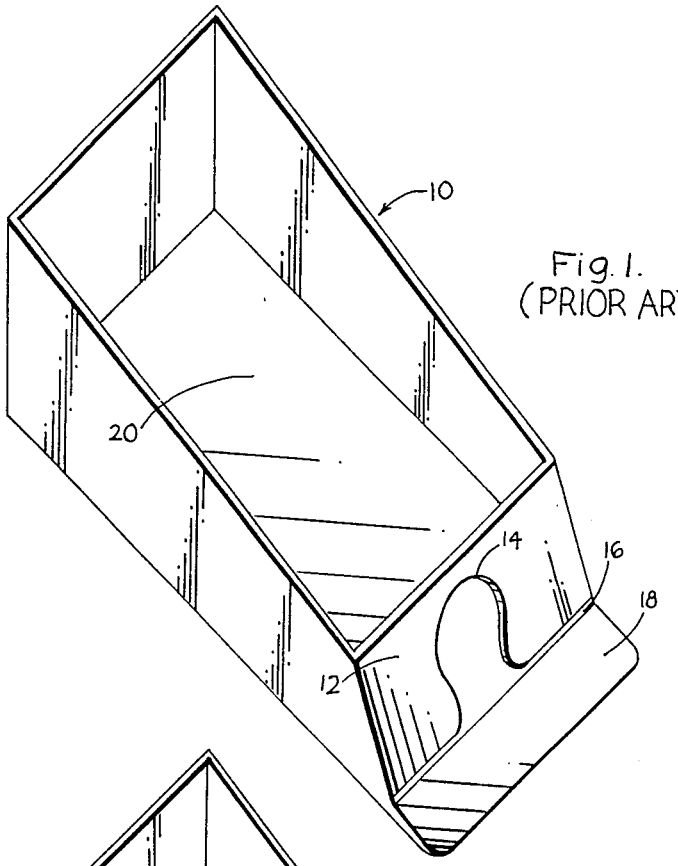
Fig. 1. (PRIOR ART)
FIG. 1 is a perspective view of a playing-card dealing shoe.

Referring to FIG. 1, a playing-card dealing shoe 10 as known in the art is shown. The shoe 10 comprises a front panel 12 having an opening 14 therethrough. The panel 12 is positioned to provide a slot 16 between its bottom edge and the floor 18 of the shoe 10. A dealer withdraws one card at a time from the interior 20 of the shoe 10 where cards are stocked so that their back sides are seen through the opening 14. To perform this card withdrawal, the dealer places a finger through the opening 14 and slides the first card presented downwardly and out through the slot 16.

Figure 2:
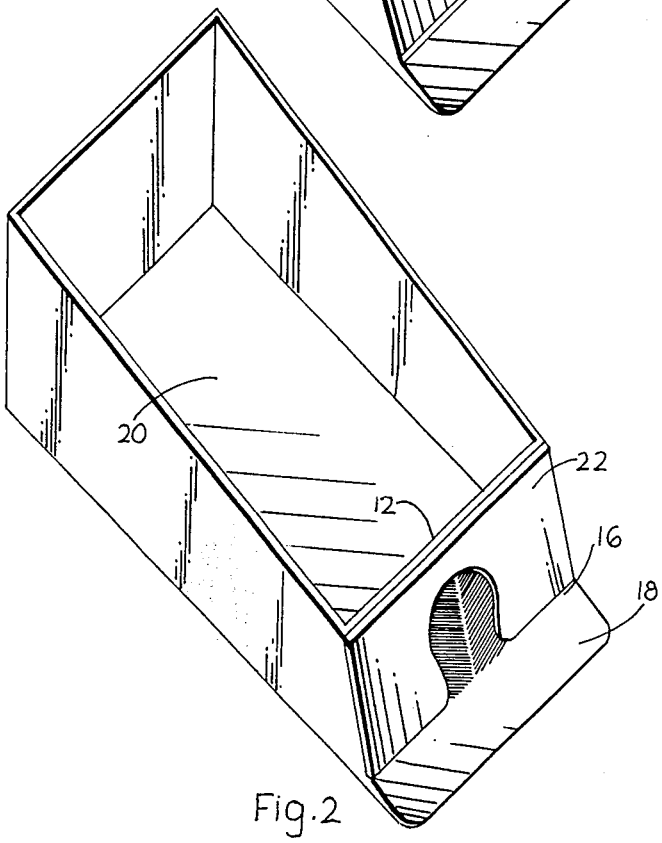
FIG. 2 is a perspective view of the shoe of FIG. 1 having attached thereto a card-dispenser guard apparatus.
Figure 3:
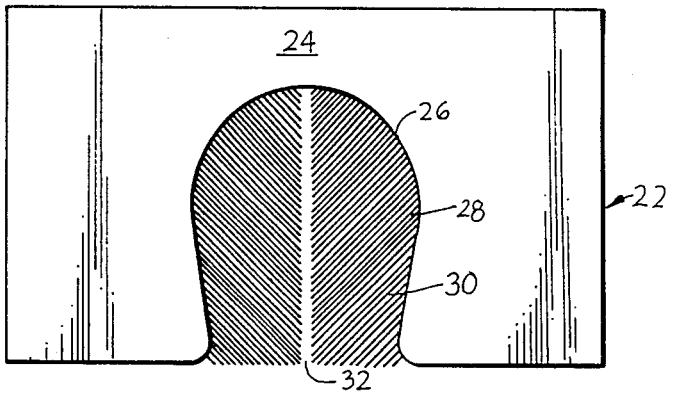
FIG. 3 is a front elevational view of a card-dispenser guard apparatus.
Figure 4:
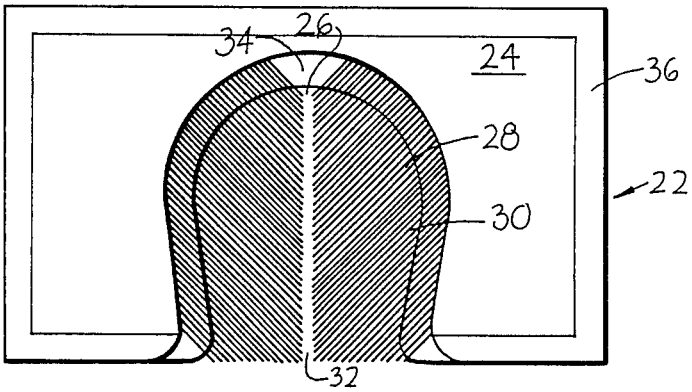
FIG. 4 is a rear elevational view of the card-dispenser guard apparatus of FIG. 3.

FIG. 2 shows the shoe 10 with a card-dispenser guard apparatus 22 secured to the front panel 12 of said shoe 10. Referring to FIGS. 2–4, the apparatus 22 comprises a plate 24 having an opening 26 therethrough, with the opening 26 having disposed therein flexible closure means 28 partable along an essentially vertical axis thereof. In the embodiment of FIGS. 2–4, the flexible closure means 28 comprises a plurality of closely adjacent paint-brush type bristles 30 which extend from the perimeter of the opening 26 and meet along a vertical axis of the opening 26 essentially mid-way between the lateral sides of said opening 26 to thus provide bristles 30 extending from the right and left perimeters of the opening 26. The bristles 30 extend from the right and left perimeters at opposing downward angles as measured from a horizontal plane, with said angles and the ends of the bristles 30 converging along said vertical axis. At the site of this vertical axis, a narrow vertical opening 32 is thus formed between the ends of the converging bristles 30. The illustrated angle of the bristles 30 as measured from a horizontal plane is about 45°, but angles from about 20° to about 70° can be chosen.

As illustrated in FIG. 4, a rear elevational view of the apparatus 22, the tops of the bristles 30 are glued in place to an inset channel 34 surrounding the opening 26. In actual assembly, bristles of a common size can be first glued in place, and then can be trimmed to achieve the configuration shown. When the bristles 30 become worn, they can easily be replaced with new bristles by simply removing the old bristles using a glue solvent. Alternatively, the bristles can be mounted on a pre-cut pressure sensitive adhesive member which can be applied to and removed from the inset channel 34. The rear of the apparatus 22 can be provided along its perimeter with a pressure-sensitive adhesive material 36 as desired. Otherwise, a separate adhesive can be applied.

When installed, as illustrated in FIG. 2, the apparatus 22 is secured to the front panel 12 of the shoe 10 so that the opening 14 of the panel 12 and the opening 26 of the apparatus 22 register with each other. As desired, the opening 26 can be made slightly larger than the opening 14 of the shoe 10. In use, a dealer places a finger through the opening 26, and preferably through the vertical opening 32 between the ends of the bristles 30, and then through the opening 14 of the panel 12 to then slide the first card downwardly through the slot 16. Because the bristles 30 are tensioned strands naturally maintained under tension in a downward angle as shown, such tensioning inhibits the dealer from being able to raise the first card upwardly and withdraw a card disposed behind said first card. Further, of course, the bristles 30 conceal from view the surfaces of the respective playing cards to be dealt, thereby hiding any mark on a card from both the dealer and the players.

Construction of the plate 24 here shown is of rigid plastic, but can be of any material which would be recognized by those with ordinary skill in the art as being satisfactory for the purposes here set forth. The bristles 30 can be made of nylon, plastic, or the like, so long as the material chosen is flexible and tends toward maintenance of the angle of setting.

Figure 7:
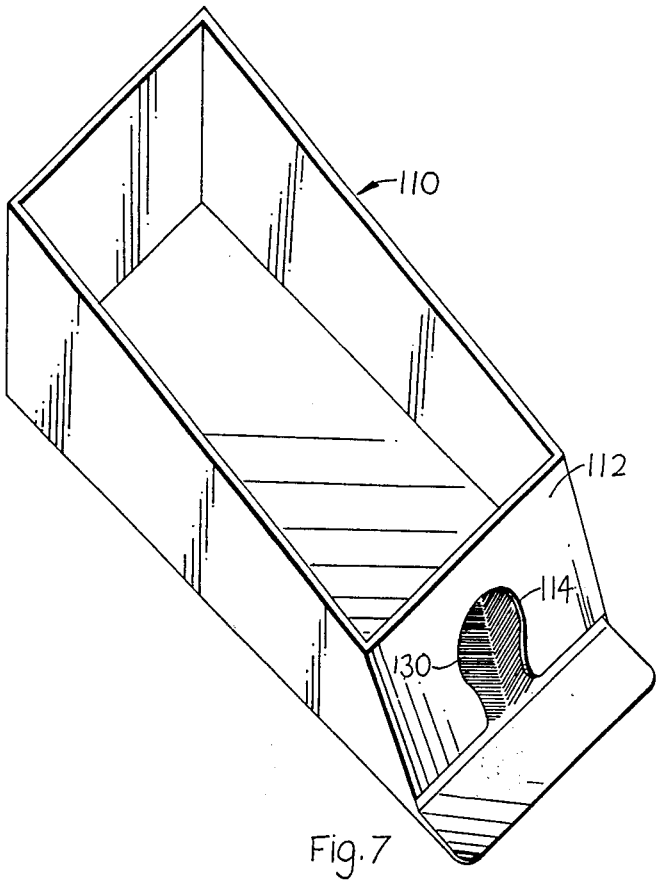
FIG. 7 is a perspective view of a playing-card dealing shoe whose front panel comprises a card-dispenser guard apparatus.

As illustrated in FIG. 7, a playing-card dealing shoe 110 can have a front panel 112 itself whose opening 114 is provided with downwardly-angled converging bristles 130 in the same manner as shown and described for the apparatus 22.

Figure 5:
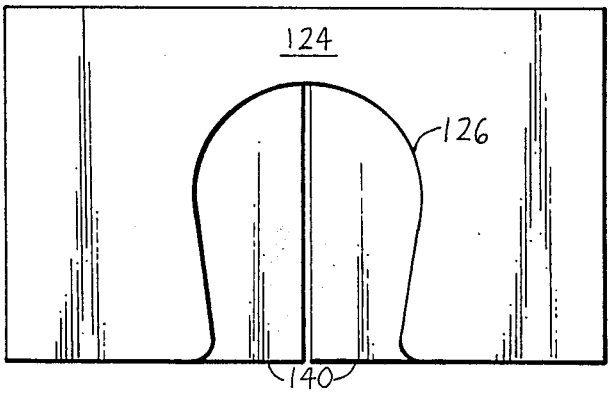
FIG. 5 is a front elevational view of a second embodiment of a card-dispenser guard apparatus.

FIG. 5 illustrates a second embodiment of a card-dispenser guard apparatus 122. This apparatus 122 comprises a plate 124 having an opening 126 therethrough, with the opening 126 having disposed therein a flexible opaque curtain 140 extending from the perimeter of the opening and split vertically into two halves essentially mid-way between the lateral sides of said opening 126. The curtain 140 is thereby partable along a vertical axis corresponding to the vertical split. As is evident the curtain 140 conceals from view the back side of a card next to be dealt. Construction material choices for the plate 124 are the same as those for the plate 24 of FIGS. 2–4, while the curtain 140 is constructed of a flexible material such as polyethylene, cloth, or other such material. The curtain 140 is glued to an inset channel (not shown) surrounding the opening 126 on the back side of the plate 124.

Figure 6:
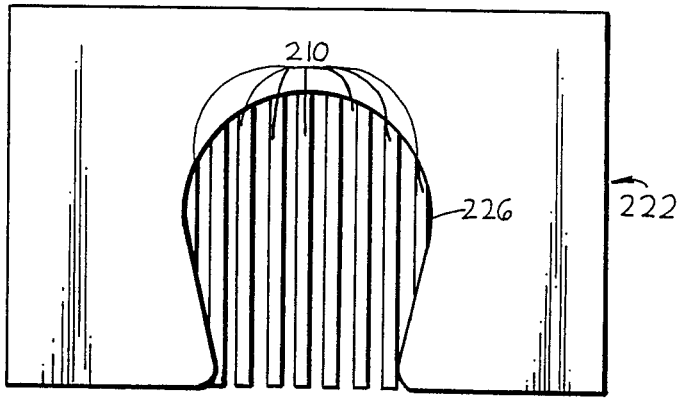
FIG. 6 is a front elevational view of a third embodiment of a card-dispenser guard apparatus.

FIG. 6 illustrates a third embodiment of a card-dispenser guard apparatus 222. This apparatus 222 comprises a plate 224 having an opening 226 therethrough, with the opening 226 having disposed therein flexible closure means comprising a plurality of flexible ribbons 240 extending from the top perimeter of the opening 226. Said flexible closure means is thereby partable along several vertical axes. As is evident, the ribbons 240 conceal from view the back side of a card next to be dealt. Construction material choices for the plate 124 are the same as those for the plate 24 of FIGS. 2–4, while the ribbons 240 are constructed of a flexible material such as polyethylene, cloth, or other such material. The ribbons 240 are glued to an inset channel (not shown) surrounding the opening 226 on the back side of the plate 224.

As is evident in the Figures, the respective openings 14, 26, 114, 126, 226 have no wall along their lower edges. It therefore is to be understood that the term "opening" as used herein is defined to include an orifice with a wall around an entire perimeter as well as around only a portion of a perimeter.

It is to be understood that the detailed description of preferred embodiments appearing above is meant to be illustrative and not limiting, and that the scope of the invention is defined by the claims which now follow.

What is claimed is:

1. A card-dispenser guard apparatus for a playing-card dealing shoe, said apparatus comprising a plate having a front side, a back side, and an opening therethrough, said opening having disposed therein a flexible closure means partable along a vertical axis thereof, wherein the flexible closure means comprises a plurality of closely adjacent tensioned strands which extend from the perimeter of the opening and whose ends meet along a vertical axis of the opening essentially mid-way between the lateral sides of said opening to thereby provide right strands extending from the right perimeter and left strands extending from the left perimeter of the opening.

2. A card-dispenser guard apparatus for a playing-card dealing shoe, said apparatus comprising a plate having a front side, a back side, and an opening therethrough, said opening having disposed therein a flexible closure means partable along a vertical axis thereof, wherein the flexible closure means comprises a plurality of closely adjacent tensioned strands which extend from the perimeter of the opening and whose ends meet along a vertical axis of the opening essentially mid-way between the lateral sides of said opening to thereby provide right strands extending from the right perimeter and left strands extending from the left perimeter of the opening, wherein said right and left strands extend at opposing downward angles as measured from a horizontal plane and wherein said angles and the ends of the right and left strands converge along said vertical axis.

3. A card-dispenser guard apparatus for a playing-card dealing shoe, said apparatus comprising a plate having a front side, a back side, and an opening therethrough, said opening having disposed therein a flexible closure means partable along a vertical axis thereof, wherein the flexible closure means comprises a plurality of closely adjacent tensioned strands which extend from the perimeter of the opening and whose ends meet along a vertical axis of the opening essentially mid-way between the lateral sides of said oening to thereby provide right strands extending from the right perimeter and left strands extending from the left perimeter of the opening, and wherein the tensioned strands are bristles.

4. A card-dispenser guard apparatus for a playing-card dealing shoe, said apparatus comprising a plate having a front side, a back side, and an opening therethrough, said opening having disposed therein a flexible closure means partable along a vertical axis thereof, wherein the flexible closure means comprises a plurality of closely adjacent tensioned strands which extend from the perimeter of the opening and whose ends meet along a vertical axis of the opening essentially mid-way between the lateral sides of said opening to thereby provide right strands extending from the right perimeter and left strands extending from the left perimeter of the opening, and wherein the tops of the tensioned strands are secured in an inset channel disposed in the back side of the plate and surrounding the opening.

5. A playing-card dealing shoe comprising a front panel comprising a plate having an opening therethrough, said opening having disposed therein a flexible closure means partable along a vertical axis thereof, wherein the flexible closure means comprises a plurality of closely adjacent tensioned strands which extend from the perimeter of the opening and whose ends meet along a vertical axis of the opening essentially mid-way between the lateral sides of said oening to thereby provide right strands extending from the right perimeter and left strands extending from the left perimeter of the opening.

6. A playing-card dealing shoe comprising a front panel comprising a plate having an opening therethrough, said opening having disposed therein a flexible closure means partable along a vertical axis thereof, wherein the flexible closure means comprises a plurality of closely adjacent tensioned strands which extend from the perimeter of the opening and whose ends meet along a vertical axis of the opening essentially mid-way between the lateral sides of said oening to thereby provide right strands extending from the right perimeter and left strands extending from the left perimeter of the opening, and wherein said right and left strands extend at opposing downward angles as measured from a horizontal plane and wherein said angles and the ends of the right and left strands converge along said vertical axis.

7. A playing-card dealing shoe comprising a front panel comprising a plate having an opening therethrough, said opening having disposed therein a flexible closure means partable along a vertical axis thereof, wherein the flexible closure means comprises a plurality of closely adjacent tensioned strands which extend from the perimeter of the opening and whose ends meet along a vertical axis of the opening essentially mid-way between the lateral sides of said oening to thereby provide right strands extending from the right perimeter and left strands extending from the left perimeter of the opening, and wherein the tensioned strands are bristles.

* * * * *